US009428908B2

(12) United States Patent
Laraway et al.

(10) Patent No.: US 9,428,908 B2
(45) **Date of Patent: *Aug. 30, 2016**

(54) MOVABLE PARTITION SYSTEMS AND METHODS OF ALIGNING A LEADING END OF A MOVABLE PARTITION

(71) Applicant: Won-Door Corporation, Salt Lake City, UT (US)

(72) Inventors: Mark B. Laraway, West Jordan, UT (US); William Michael Coleman, Salt Lake City, UT (US); Evan Easton, Aurora, CO (US); Mike Draper, West Valley City, UT (US)

(73) Assignee: Won-Door Corporation, Salt Lake City, UT (US)

( * ) Notice: Subject to any disclaimer, the term of this patent is extended or adjusted under 35 U.S.C. 154(b) by 28 days.

This patent is subject to a terminal disclaimer.

(21) Appl. No.: 14/523,437

(22) Filed: Oct. 24, 2014

(65) Prior Publication Data

US 2015/0040498 A1 Feb. 12, 2015

Related U.S. Application Data

(63) Continuation of application No. 13/720,804, filed on Dec. 19, 2012, now Pat. No. 8,869,867, which is a continuation of application No. 12/857,412, filed on Aug. 16, 2010, now Pat. No. 8,336,597.

(51) Int. Cl.

| | |
|---|---|
| ***E04B 2/88*** | (2006.01) |
| ***E04B 2/96*** | (2006.01) |
| ***E05F 15/632*** | (2015.01) |
| ***E05F 15/643*** | (2015.01) |

(Continued)

(52) U.S. Cl.

CPC . *E04B 2/96* (2013.01); *E04B 2/88* (2013.01); *E05F 15/632* (2015.01); *E05F 15/643* (2015.01); *E05D 15/063* (2013.01); *E05Y 2201/614* (2013.01); *E05Y 2201/684* (2013.01); *E05Y 2201/688* (2013.01); *E05Y 2900/142* (2013.01); *E06B 3/94* (2013.01); *Y10T 29/49826* (2015.01)

(58) Field of Classification Search

CPC ... E04B 2/88; E05D 15/063; E05D 15/0634; E05Y 2900/142

USPC ..... 160/40, 199, 206, 201, 196.1, 197, 198; 52/71, 64; 16/87 R–96 L, 82–86 C

See application file for complete search history.

(56) References Cited

U.S. PATENT DOCUMENTS

| | | | | |
|---|---|---|---|---|
| 2,962,132 | A | 11/1960 | Reinhardt | |
| 2,990,566 | A | 7/1961 | Lee | |
| 3,071,825 | A * | 1/1963 | Ferris | B65G 9/002 104/105 |

(Continued)

*Primary Examiner* — David Purol
(74) *Attorney, Agent, or Firm* — TraskBritt

(57) ABSTRACT

Movable partition systems include a vertical alignment structure including at least one roller element coupled to a portion of a movable partition and a ramp configured to abut against the at least one roller element to vertically align the portion of the movable partition to engage with a strike plate. Methods of vertically aligning the movable partition include coupling at least one vertical alignment structure to the movable partition including coupling at least one structural frame member to the movable partition and coupling the at least one roller element to the at least one structural frame member and installing at least one ramp to an overhead structure configured to abut the at least one roller element and vertically align a leading end of the movable partition.

20 Claims, 6 Drawing Sheets

(51) Int. Cl.
*E05D 15/06* (2006.01)
*E06B 3/94* (2006.01)

(56) References Cited

U.S. PATENT DOCUMENTS 3,221,804 A 12/1965 Jack
3,241,197 A 3/1966 Gogerty
3,431,678 A 3/1969 Stuart, Jr. et al.
3,509,934 A 5/1970 Smart
4,133,364 A * 1/1979 Smart ..... E05D 15/06 160/199
6,003,201 A 12/1999 Ryczek
6,438,795 B1 8/2002 Haab et al.
6,598,355 B2 7/2003 Owens
7,478,663 B2 1/2009 Goodman et al.
8,336,597 B2 * 12/2012 Laraway ..... E05F 15/14 160/196.1
8,869,867 B2 * 10/2014 Laraway ..... E05F 15/14 160/196.1
2008/0105387 A1 5/2008 Coleman et al.
2008/0169069 A1 7/2008 Coleman et al.
2013/0104476 A1 5/2013 Laraway et al.

* cited by examiner

MOVABLE PARTITION SYSTEMS AND METHODS OF ALIGNING A LEADING END OF A MOVABLE PARTITION

CROSS-REFERENCE TO RELATED APPLICATIONS

This application is a continuation of U.S. patent application Ser. No. 13/720,804, filed Dec. 19, 2012, now U.S. Pat. No. 8,869,867, issued Oct. 28, 2014, which application is a continuation of U.S. patent application Ser. No. 12/857,412, filed Aug. 16, 2010, now U.S. Pat. No. 8,336,597, issued on Dec. 25, 2012, the disclosure of each of which is hereby incorporated herein in its entirety by this reference.

TECHNICAL FIELD

Embodiments of the present invention are directed to the field of movable partitions used for one or more of partitioning space, as sound barriers, fire barriers, security barriers, or for various other applications.

BACKGROUND

Movable partitions are utilized in numerous situations and environments for a variety of purposes. Such partitions may include, for example, a movable partition comprising foldable or collapsible doors configured to enclose or subdivide a room or other area. Often such partitions may be utilized simply for purposes of versatility in being able to subdivide a single large room into multiple smaller rooms. The subdivision of a larger area may be desired, for example, to accommodate multiple groups or meetings simultaneously. In other applications, such partitions may be utilized for noise control depending, for example, on the activities taking place in a given room or portion thereof.

Movable partitions may also be used to provide a security barrier, a fire barrier, or both a security barrier and a fire barrier. In such a case, the partition barrier may be configured to automatically close upon the occurrence of a predetermined event such as the actuation of an associated alarm. For example, one or more accordion or similar folding-type partitions may be used as a security barrier, a fire barrier, or both a security barrier and a fire barrier wherein each partition is formed with a plurality of panels connected to one another with hinges. The hinged connection of the panels allows the partition to fold and collapse into a compact unit for purposes of storage when not deployed. The partition may be stored in a pocket formed in the wall of a building when in a retracted or folded state. When the partition is deployed to subdivide a single large room into multiple smaller rooms, secure an area during a fire, or for any other specified reason, the partition may be extended along an overhead track, which is often located above the movable partition in a header assembly, until the partition extends a desired distance across the room.

When deployed, a leading end of the movable partition, often defined by a component known as a lead post, complementarily engages another structure, such as a wall, a post, or a lead post of another door.

Automatic extension and retraction of the movable partition may be accomplished through the use of a motor located in a pocket formed in the wall of a building in which the movable partition is stored when in a retracted or folded state. The motor, which remains fixed in place within the pocket, may be used to drive extension and retraction of the movable partition. A motor for automatically extending and retracting a movable partition may also be mounted within the movable partition itself, such that the motor travels with the movable partition as the movable partition is extended and retracted using the motor.

In some cases, the lower edge of the movable partition, including the lower edge of the movable partition's lead post, may be laterally displaced relative to the top edge of the movable partition, which may be relatively fixed in a lateral sense due to engagement with an overhead track and header. Such lateral displacement of the movable partition's lower edge may be caused, for example, by a fire-induced draft, by an improperly balanced heating, ventilating, and air-conditioning (HVAC) system, by smoke evacuation systems, building air pressure systems, or simply from an occupant of a room pushing against the movable partition while it is being deployed. If the lower end of the lead post is laterally displaced relative to its upper end as the leading edge of the movable partition approaches the mating receptacle, the lead post may not be properly aligned with the mating receptacle and an appropriate seal may not be formed. In other words, the mating receptacle is conventionally installed to be substantially plumb. If the lower end of a lead post of a movable partition is laterally displaced relative to its upper end, the lead post is not plumb (or substantially vertically oriented) and, thus, may not properly engage the substantially plumb receptacle.

As noted above, the failure of the lead post to properly engage the receptacle may have significant consequences when, for example, the movable partition is being used as a fire or security barrier. One approach to preventing or controlling the lateral displacement of a lower end of the movable partition has included forming a guide track within the floor of a room, and then causing the movable partition or barrier to engage the track as it is deployed and refracted such that both the top and the bottom of the movable partition is laterally constrained. However, the placement of a track in the floor of a room is not an ideal solution for all applications. For example, such a track provides a place for collection of dust and debris and may, thereby, become an unsightly feature of the room. In some cases, the collection of debris may affect the proper operation of the movable partition itself. Furthermore, the existence of a track in the floor may act as a hazard or potential source of injury depending, for example, on the intended use of the area and the actual location of the floor track within that area.

BRIEF SUMMARY

In accordance with one aspect of the invention, a movable partition system is provided. The movable partition system includes a movable partition configured to extend across a space within a building when the movable partition system is installed within a building. At least one track is configured to be coupled to an overhead structure of the building and to extend across the space when the movable partition is installed within the building. The movable partition is configured to be suspended from the at least one track when the movable partition is installed within the building. A strike plate is configured to be mounted to a wall within the building when the movable partition system is installed within the building, the strike plate being configured to engage the leading end of the movable partition when the movable partition is extended across the space within the building to an extended, closed configuration. A vertical alignment structure is coupled to the movable partition proximate a leading end of the movable partition, which comprises at least one roller element located laterally beyond a lateral side of the movable partition and at least one structural frame member coupling the at least one roller element to the movable partition, the at least one structural frame member coupled to the at least one roller element and to at least one component of the movable partition. At least one ramp is configured to be coupled to the overhead structure of the building when the movable partition system is installed within the building. The at least one ramp has at least one ramp surface configured to be orientated at an acute angle greater than zero relative to the horizontal plane. The at least one ramp surface is configured to abut against the at least one roller element as the movable partition is caused to extend across the space within the building to the extended, closed configuration and to cause the leading end of the movable partition to be aligned with the strike plate as the leading end of the movable partition engages the strike plate.

In accordance with another aspect of the present invention, a system for vertically aligning an automatic door is provided. The system comprises a movable partition configured to extend across a space within a building when the movable partition system is installed within a building. A drive is configured to motivate the movable partition along at least one track configured to be coupled to an overhead structure of the building. The movable partition is configured to be suspended from the at least one track. A vertical alignment structure comprising at least one roller element is coupled to an upper portion of the at least one component of the movable partition and at least one ramp is configured to be coupled to the overhead structure of the building. The at least one ramp has at least one ramp surface configured to be orientated at an acute angle greater than zero relative to the horizontal plane, the at least one ramp surface is configured to abut against the at least one roller element as the drive motivates the movable partition along the at least one track and causes the leading end of the movable partition to be at least substantially perpendicular to the horizontal plane.

In accordance with yet another aspect of the present invention, a method of forming a movable partition system is provided. The method includes installing at least one track to an overhead structure of a building with the at least one track extending across a space within the building. A movable partition comprising a leading end is suspended from the at least one track. A strike plate is mounted to a wall within the building and is configured to engage the leading end of the movable partition. At least one vertical alignment structure is coupled to the movable partition that includes coupling at least one structural frame member to at least one component of the movable partition and coupling at least one roller element to the at least one structural frame member such that the at least one roller element is located laterally beyond a lateral side of the movable partition. At least one ramp is installed to the overhead structure of the building when the movable partition system is installed within the building. The at least one ramp has at least one ramp surface that is orientated at an acute angle greater than zero relative to the horizontal plane. The at least one ramp is configured to abut the at least one roller element and align the leading end of the movable partition with the strike plate when the movable partition is extended across the space within the building.

BRIEF DESCRIPTION OF THE DRAWINGS

While the specification concludes with claims particularly pointing out and distinctly claiming what are regarded as embodiments of the present invention, the advantages of the embodiments of the invention may be more readily ascertained from the description of embodiments of the invention when read in conjunction with the accompanying drawings, in which:

DETAILED DESCRIPTION

Figure 1:
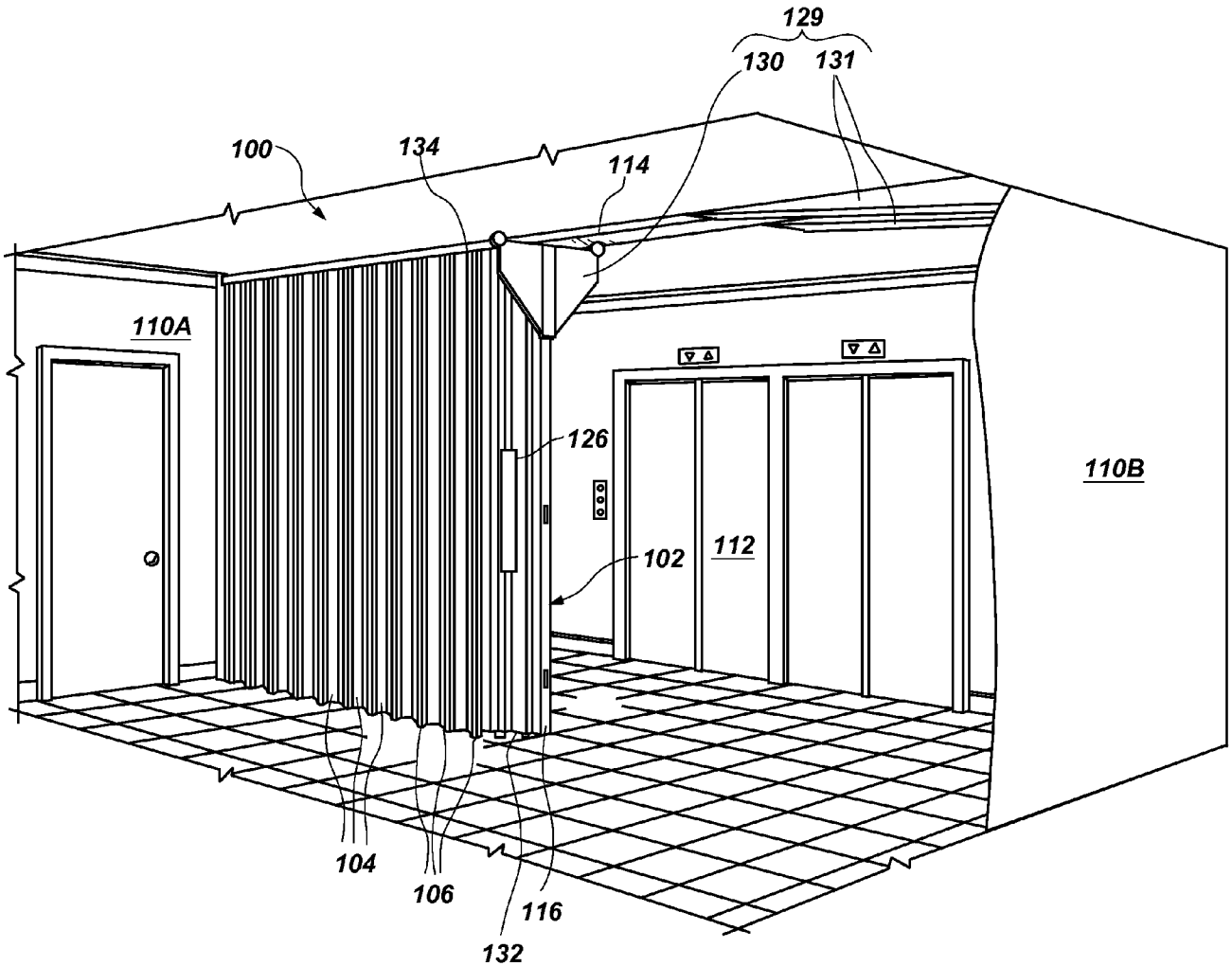
FIG. 1 is a perspective view of an embodiment of a movable partition system of the present invention.
Figure 2:
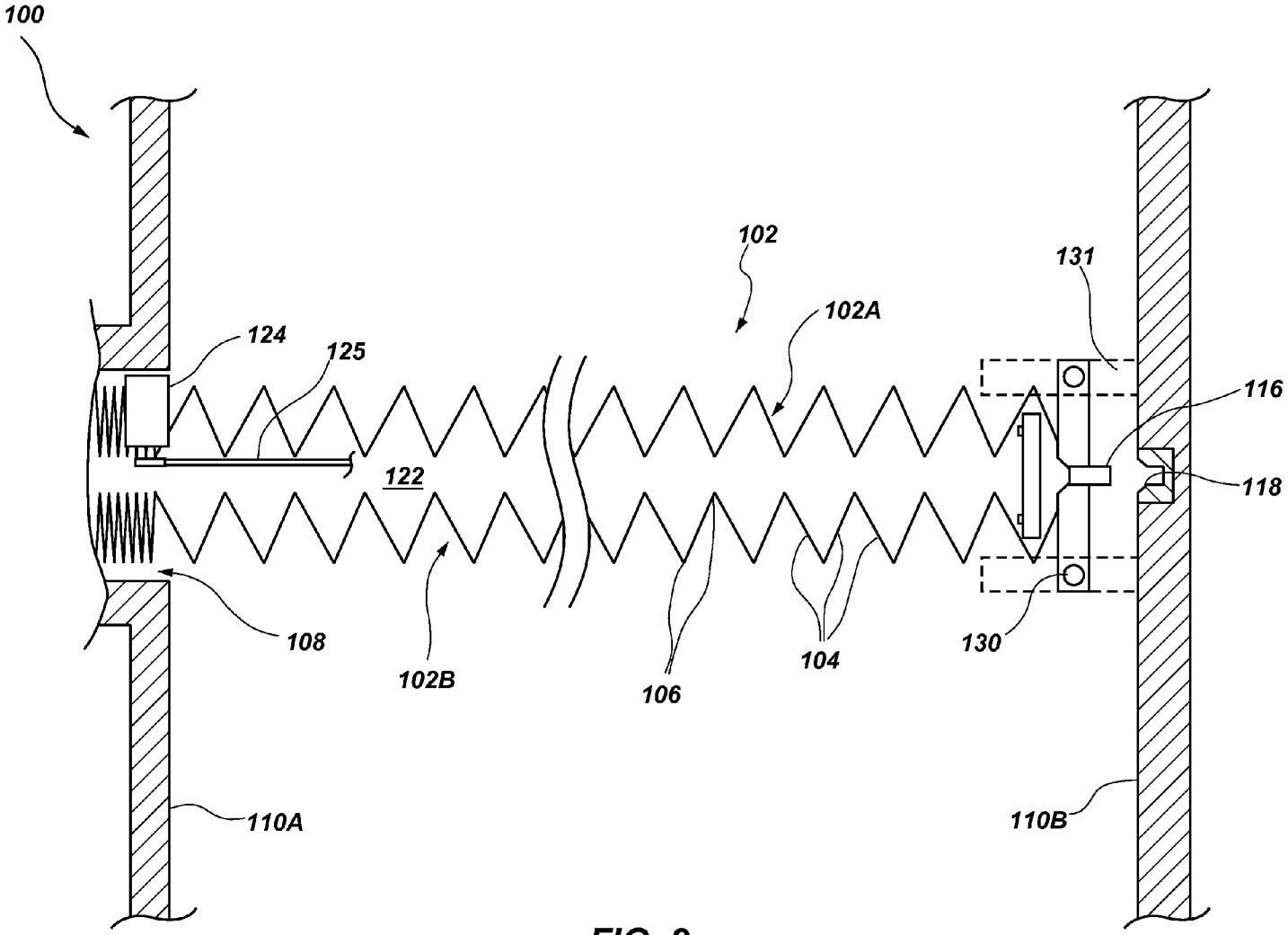
FIG. 2 is a simplified, schematic horizontal cross-sectional view of components of the movable partition system of FIG. 1.
Figure 3:
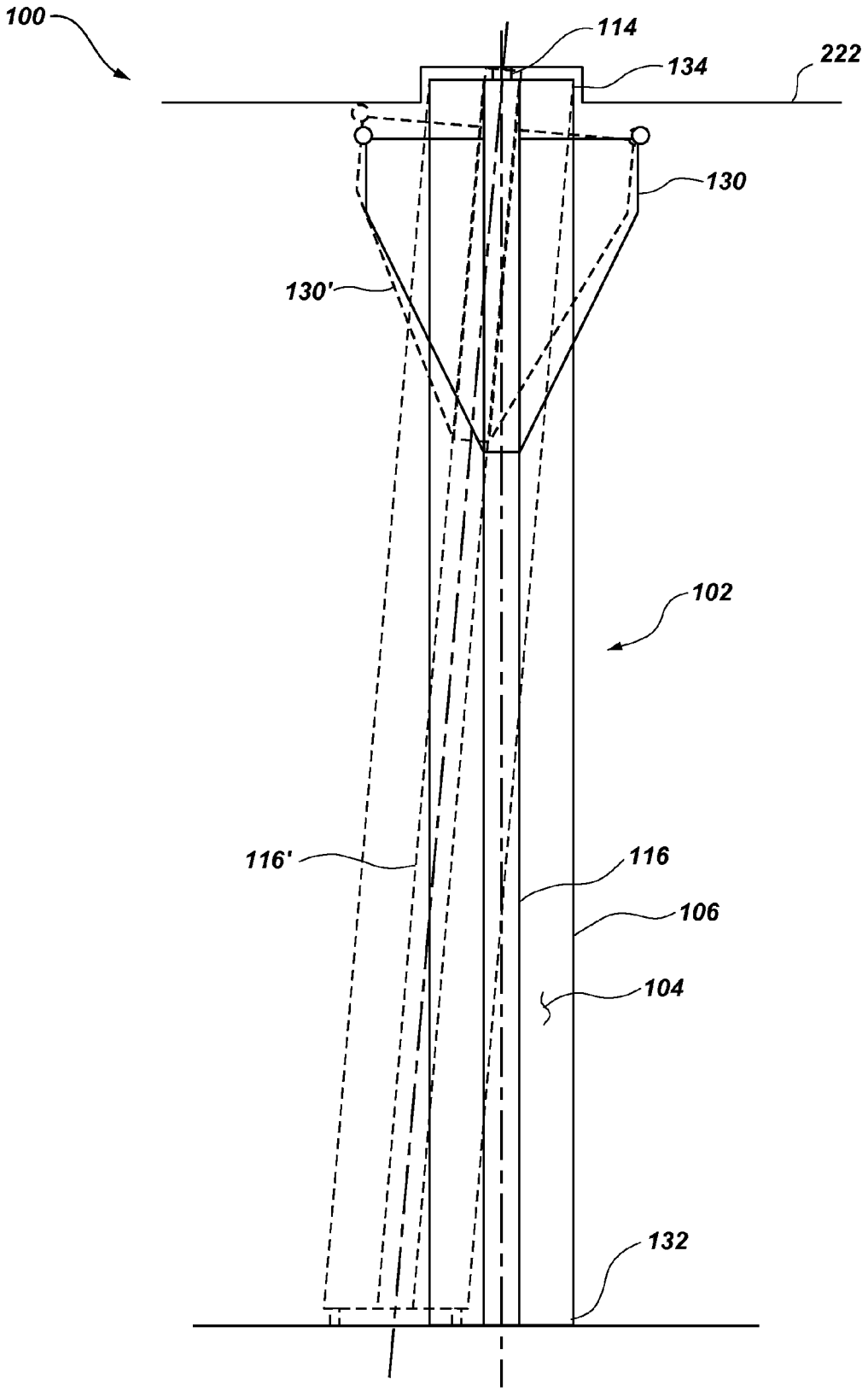
FIG. 3 is a simplified, schematic front view of the movable partition system of FIG. 1.

Referring to FIGS. 1-3, an automatic movable partition system 100 is shown that includes a movable partition in the form of an accordion-type door 102. The door 102 may be configured to extend across a space within a building when the movable partition system 100 is installed within a building. The door 102 may be used, for example, as a security and/or fire door. In other embodiments, the door 102 need not be utilized as a fire or security door, but may be used simply for the subdividing of a larger space into smaller rooms or areas. The door 102 may be formed with a plurality of panels 104 that are connected to one another with hinges or other hinge-like members 106. The hinged connection of the panels 104 allows the door 102 to be compactly stored in a pocket 108 formed in a wall 110A of a building when in a retracted or folded state.

When it is desired to deploy the door 102 to an extended position, for example, to secure an area such as an elevator lobby 112 during a fire, the door 102 is driven along at least one track 114 across the space to provide an appropriate barrier. The at least one track 114 may be configured to be coupled to an overhead structure of the building and to extend across the space when the movable partition system 100 is installed within the building. The door 102 may be configured to be suspended from the at least one track 114. When in a deployed or an extended state, a leading edge of the door 102, shown to include a male lead post 116, complementarily or matingly engages with a door post or strike plate 118 that may be formed in a wall 110B of a building. The strike plate 118 may be configured to be mounted to the wall 110B of a building when the movable partition system 100 is installed within the building. As can be seen in FIG. 2, an accordion-type door 102 may include a first sheet 102A of panels 104 and a second sheet 102B of panels 104, which is laterally spaced from the first sheet 102A. Such a configuration may be utilized as a fire door wherein one sheet 102A of panels 104 acts as a primary fire and smoke barrier, the space 122 between the two sheets 102A and 102B of panels 104 acts as an insulator or a buffer zone, and the second sheet 102B of panels 104 acts as a secondary fire and smoke barrier. Such a configuration may also be useful in providing an acoustical barrier when the door 102 is used to subdivide a larger space into multiple, smaller rooms.

A drive device, which may include, for example, a motor 124 and a drive belt or chain 125 (FIG. 2), may be configured to open and close the door 102 upon actuation thereof. The movable partition system 100 may further include various sensors and switches to assist in the control of the door 102 through appropriate connection with the drive device. For example, as shown in FIG. 1, when used as a fire door, the door 102 may include a switch or actuator 126, commonly referred to as "panic hardware." Actuation of the panic hardware 126 allows a person located on one side of the door 102 to cause the door 102 to open if it is closed, or to stop while it is closing, allowing access through the barrier formed by the door 102 for a predetermined amount of time.

It is noted that, while the exemplary embodiment shown and described with respect to FIGS. 1 and 2 is directed to a single accordion-type door 102, other movable partitions may be utilized. For example, a two-door, or bi-part door, system may be utilized wherein two similarly configured doors extend across a space and join together to form an appropriate barrier. In such a two-door system, a vertical alignment system 129 as described herein may be placed on one or both doors to ensure vertical alignment of one or both doors with each other. Also, the present invention is applicable to movable partitions or barriers other than the accordion-type doors that are shown and described herein.

Referring still to FIGS. 1-3, the door 102 of the present invention further includes a vertical alignment system 129 that may be used to ensure vertical alignment of the door 102 or at least a portion thereof. The vertical alignment system 129 includes a vertical alignment structure 130 and at least one ramp 131. For example, upon the exertion of an external force, such as by a draft or from an individual pushing on the door 102 while it is being deployed or retracted, the lead post 116 (or some other section of the door 102) may deviate from its intended plumb orientation, or substantially vertical orientation, as indicated by dashed lines at 116' in FIG. 3. In other words, a lower portion of the door 102, such as the lower edge 132, may become laterally displaced relative to the upper edge 134 of the door 102, which is substantially laterally fixed by virtue of its engagement with the at least one track 114. As previously discussed, in such a case where the lead post 116 is out of plumb (e.g., not substantially vertically oriented), the lead post 116 will not properly engage the door post or strike plate 118 and will prevent the door 102 from properly closing and forming a proper barrier. However, in accordance with the present invention, the vertical alignment system 129 may be configured to correct a deviation of the door 102 from its desired course or orientation.

It is noted that, while embodiments of the present invention are generally discussed with respect to correcting a section of the door 102 or other partition that has deviated from a substantially plumb or vertical orientation through use of a vertical alignment system 129, embodiments of the present invention more broadly contemplate positioning a section of the door 102 to a selected or specified orientation.

For example, an existing or previously installed door 102 may be retrofitted or modified to include a vertical alignment system 129. In certain installations, the strike plate 118, with which a lead post 116 will engage, may have been improperly or carelessly installed such that it is out of plumb by a determined magnitude. In such a case, the vertical alignment system 129 may be configured to guide the lead post 116 of the door 102 such that it is also out of plumb by the same magnitude, and in a corresponding direction, thereby enabling the lead post 116 to engage with the strike plate 118 and effect a desired coupling or seal therebetween.

Figure 4:
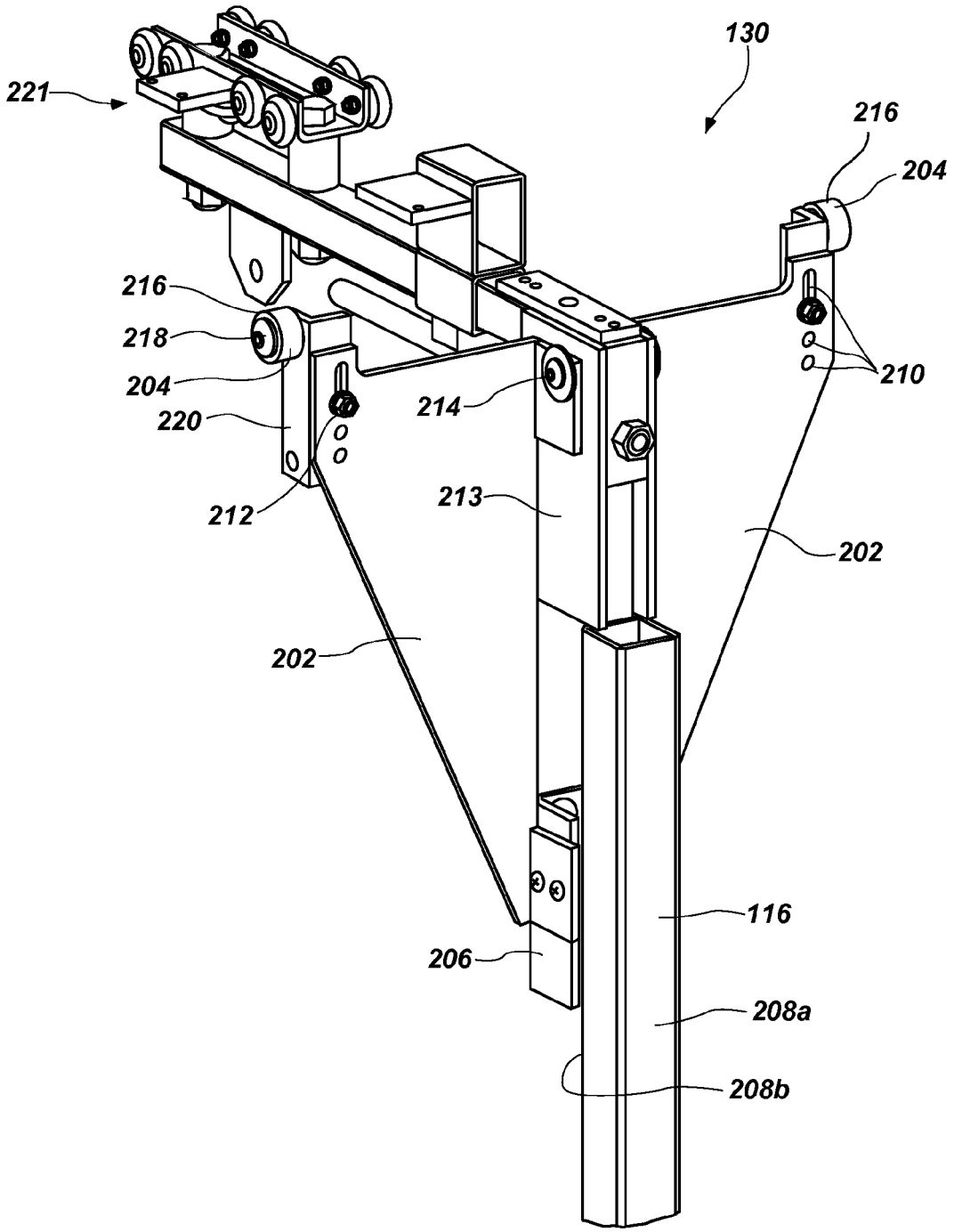
FIG. 4 is a perspective view of components of the movable partition system of FIG. 1 used for vertically aligning the movable partition as it is extended to a closed configuration.
Figure 5:
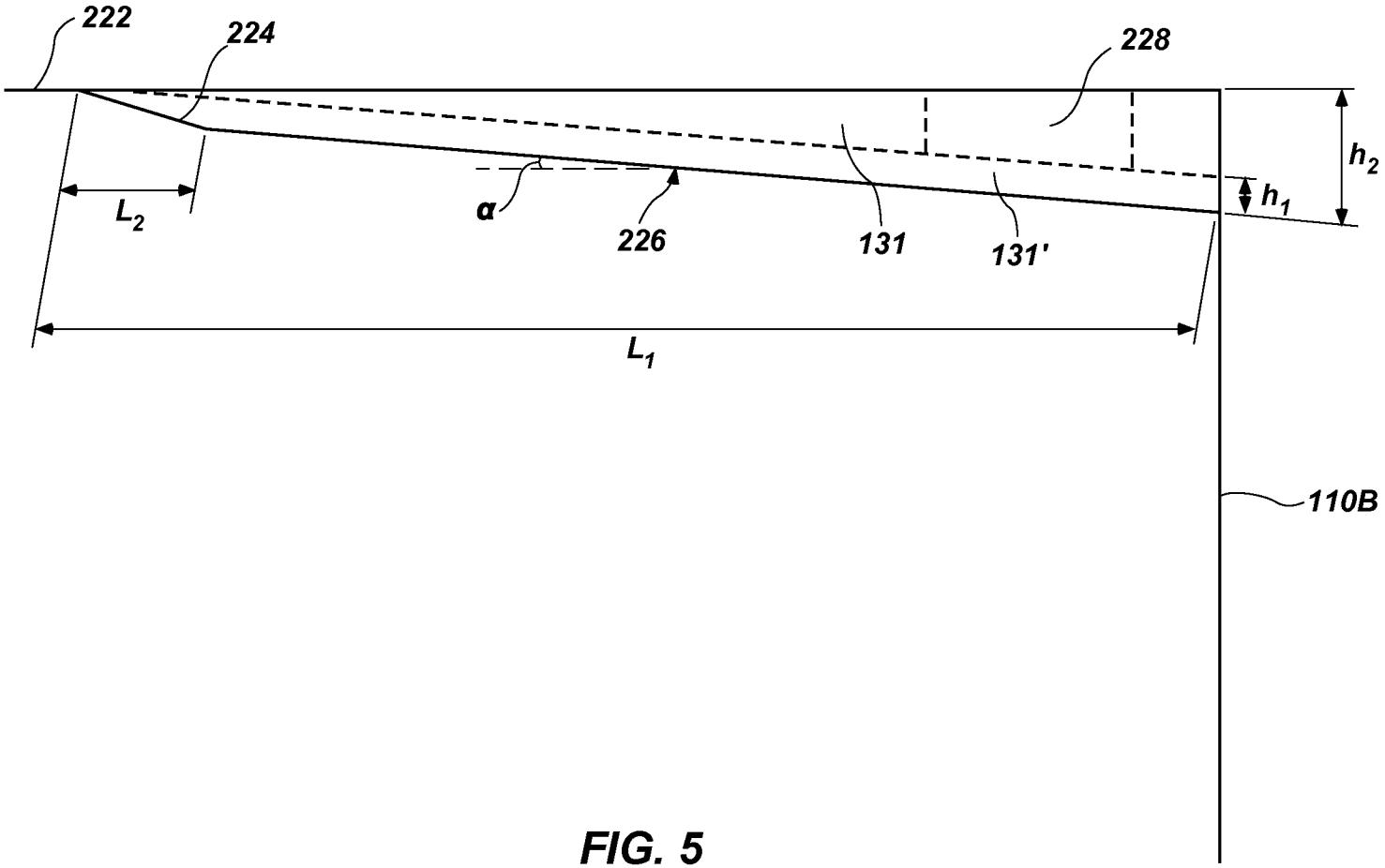
FIG. 5 is a perspective view of a ramp used in conjunction with the components shown in FIG. 4 for vertically aligning the movable partition as it is extended to a closed configuration.

Referring now to FIGS. 4 and 5, the vertical alignment system 129 (FIG. 1) includes a vertical alignment structure 130 (shown in FIG. 4) and at least one ramp 131 (shown in FIG. 5). The vertical alignment structure 130 shown in FIG. 4 may be coupled to the door 102 proximate the lead post 116. The vertical alignment structure 130 comprises at least one roller assembly 204 located laterally beyond a lateral side of the door 102. A structural frame member 202 may be used to couple the at least one roller assembly 204 to the door 102.

In some embodiments, the structural frame member 202 may be coupled to a rear surface **208*b* of an upper portion of the lead post 116. The rear surface 208*b* of the lead post 116 is also coupled to the door 102 (FIGS. 1-3) which has been omitted from FIG. 4 for clarity. A front surface 208*a* of the lead post 116 remains unobstructed by the vertical alignment structure 130 such that the lead post 116 may properly engage the door post or strike plate 118 (FIG. 2) as previously described. The vertical alignment structure 130 is also positioned so as not to obstruct a track assembly 221 from engaging with the at least one track 114 (FIG. 1). The structural frame member 202 may comprise, for example, a plate as illustrated in FIG. 4. At least one spacer 206 may be coupled to the rear surface 208*b* of the lead post 116 and positioned between the first sheet 102A and the second sheet 102B (FIG. 2) of panels 104 of the door 102. In some embodiments, a short structural vertical bar 213 may also be coupled to the lead post 116 extending vertically from an upper portion of the lead post 116. The structural frame member 202 may be coupled to the at least one spacer 206 and the vertical bar 213. The structural frame member 202 may be secured to the vertical bar 213 via a lead post bolt 214 that extends through the structural frame member 202 and the vertical bar 213. In additional embodiments, the vertical bar 213 may be omitted and the structural frame member 202 may be coupled to the at least one spacer 206 and the lead post 116, or to just the lead post 116. The lead post bolt 214 and the at least one spacer 206 not only provide a means to affix the structural frame member 202 to the lead post 116, but also may provide lateral support to the structural frame member 202 when the at least one roller assembly 204 abuts the at least one ramp 131 (FIG. 5) as described in greater detail below. The at least one spacer 206 may also provide a means to affix the structural frame member 202 to the lead post 116 without the risk of damage to the lead post 116 caused by tightly affixing the structural member 202 to the lead post 116. In further embodiments, the structural frame member 202 may be permanently coupled to the lead post 116** by, for example, welding or chemical bonding.

The structural frame member 202 includes at least one roller assembly 204 coupled therewith. In one embodiment, at least one structural frame member 202 may have a generally triangular shape and the at least one roller assembly 204 may be coupled to a corner of a structural frame member 202 opposite the lead post 116. The at least one roller assembly 204 may include a bracket 220 configured to attach at least one roller element 216 to the at least one structural frame member 202. The at least one roller element 216 may comprise, for example, a wheel configured to rotate or roll about a first axis or a rolling axis, which may be defined by a hub or axle 218 that extends through the roller element 216 and secures the roller element 216 to the bracket 220. While each roller assembly 204 is illustrated in FIG. 4 as including one roller element 216, it is understood that a plurality of wheels may be coupled to the at least one structural frame member 202.

In some embodiments, the at least one roller assembly 204 is adjustably coupled to the at least one structural frame member 202. For example, as shown in FIG. 4, the at least one structural frame member 202 may include at least two holes 210 at differing heights on the at least one structural frame member 202. In one embodiment, the structural frame member 202 may include three holes 210. The holes 210 may be spaced close together so that the height of the roller assembly 204 may be acutely adjusted. In one embodiment, an inside diameter of one hole of the at least two holes 210 may be about one-quarter (¼) inch from an inside diameter of an adjacent hole. The at least one roller assembly 204 may be attached to the at least one structural frame member 202 using a fastener 212, such as a bolt and nut, extending through one of the at least two holes 210 having the desired height. By adjustably coupling the at least one roller assembly 204 to the at least one structural frame member 202, the at least one roller assembly 204 may be adjusted to a desirable height to move the lead post 116 to a plumb position as described in greater detail below.

The horizontal distance from a center of the lead post 116 to the at least one roller assembly 204 may be about one-half (½) foot to about three (3) feet. In one embodiment, the horizontal distance may be about eight (8) inches long. In another embodiment, the vertical alignment structure 130 includes at least two roller assemblies 204 disposed substantially symmetrically about a vertical centerline of the lead post 116. The at least two roller elements 216 may have a distance $D_{204}$ (FIG. 7) between the two roller assemblies 204 of about two (2) feet to about four (4) feet. The greater the distance between the center of the lead post 116 and the at least one roller assembly 204, the greater the force that will be applied to vertically align the lead post 116 as described in greater detail below. If, for example, a force causing the lead post 116 to be out of plumb is expected to be large, such as a strong draft, then the distance between the center of the lead post 116 and the at least one roller assembly 204 may be increased to overcome the force.

FIG. 5 illustrates an enlarged lateral view of at least one ramp 131 of an embodiment of the present invention. As shown in FIG. 5, the at least one ramp 131 is configured to be coupled to an overhead structure of the building, such as to a ceiling 222 of the room adjacent the wall 110B housing the door post or strike plate 118 as described above regarding FIG. 1. The at least one ramp 131 is provided for each roller assembly 204 (FIG. 4). For example, if the vertical alignment structure 130 includes two roller elements 216, as shown in FIG. 4, then two ramps 131 may be provided. The at least one ramp 131 may be placed adjacent the at least one track 114 (FIG. 1) such that the at least ramp 131 abuts the at least one roller assembly 204 as the door 102 is caused to extend across the space within the building to the extended, closed configuration. The at least one ramp 131 may be formed of, for example, a metal (e.g. steel). In other embodiments, the at least one ramp 131 may be formed of, for example, a plastic, a composite material, and a ceramic.

In some embodiments, the at least one ramp 131 includes a beveled portion 224 where the at least one roller assembly 204 first engages the at least one ramp 131 upon closing of the door 102. The at least one ramp 131 includes a ramp surface 226 configured to be orientated at an acute angle $\alpha$ greater than zero relative to the horizontal plane. As used herein, the phrase "the horizontal plane" refers to a plane perpendicular to earth's gravitational field. For example, the angle $\alpha$ may be between about five degrees (5.degree.) and about 30 degrees (30.degree.).

In one embodiment, the at least one ramp 131 may be generally triangular such that the at least one ramp 131 is flush with the ceiling 222. In another embodiment, at least one shim 228 may be optionally placed between a generally planar at least one ramp 131' and the ceiling 222 causing the generally planar at least one ramp 131' to gradually slope downward toward the wall 110B. The thickest portion of the shim 228 may have a thickness of, for example, about one-quarter (¼) inch.

The at least one ramp 131 may have a total length $L_1$ such that when the vertical alignment structure 130 engages the at least one ramp 131, a gradually increasing downward pressure is applied from the at least one ramp 131 to the vertical alignment structure 130.

In one embodiment, the length $L_1$ of the at least one ramp 131 may be at least about three (3) ft. The beveled portion 224 of the at least one ramp 131 may have a length $L_2$ of about one (1) inch to about twelve (12) inches. A maximum height $h_2$ of the at least one ramp 131 may be from about one-quarter (¼) inch to about five (5) inches. The generally planar at least one ramp 131', excluding the beveled portion 224, may have a height $h_1$ of about one-tenth (1/10) inch to about three (3) inches. Thus, a maximum height $h_2$ from a ramp surface 226 of the at least one ramp 131 to the ceiling 222 may be from about one-quarter (¼) inch to about five (5) inches.

In some embodiments, when the at least one ramp 131 is installed and mounted to the ceiling 222, the ramp surface 226 may have a pitch (i.e., the ratio of change in height to change in length, .DELTA./.DELTA.L) of between about one-sixteenth inch per foot (1/16 in./ft.) and about two inches per foot (2 in./ft.).

Figure 7:
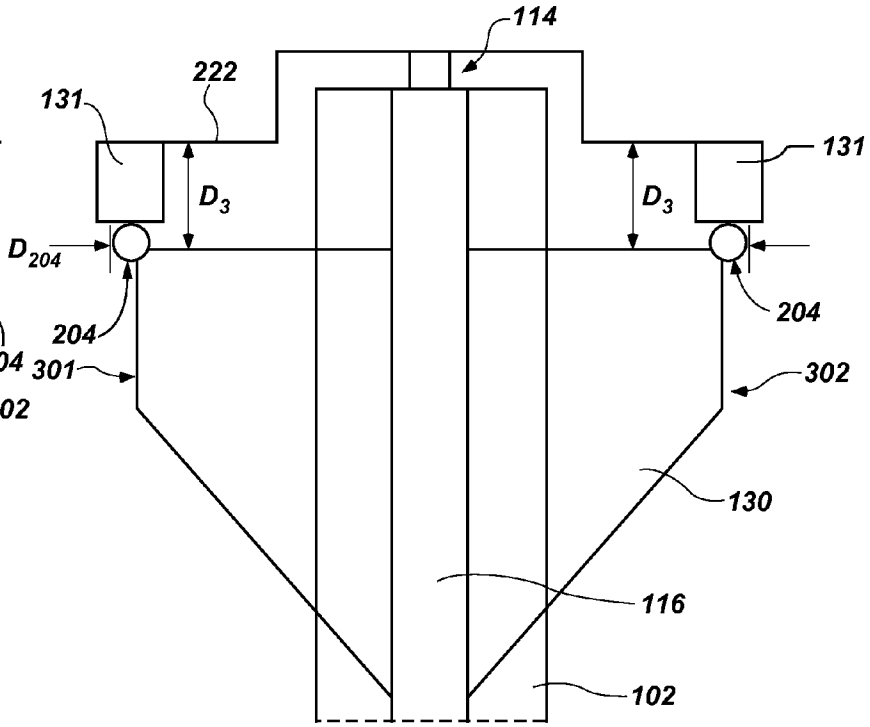
FIGS. 6 and 7 are simplified, schematic illustrations used to illustrate how the components shown in FIG. 4 and the ramp of FIG. 5 may be used to vertically align the movable partition as it is extended to a closed configuration in accordance with embodiments of the invention.
Figure 6:
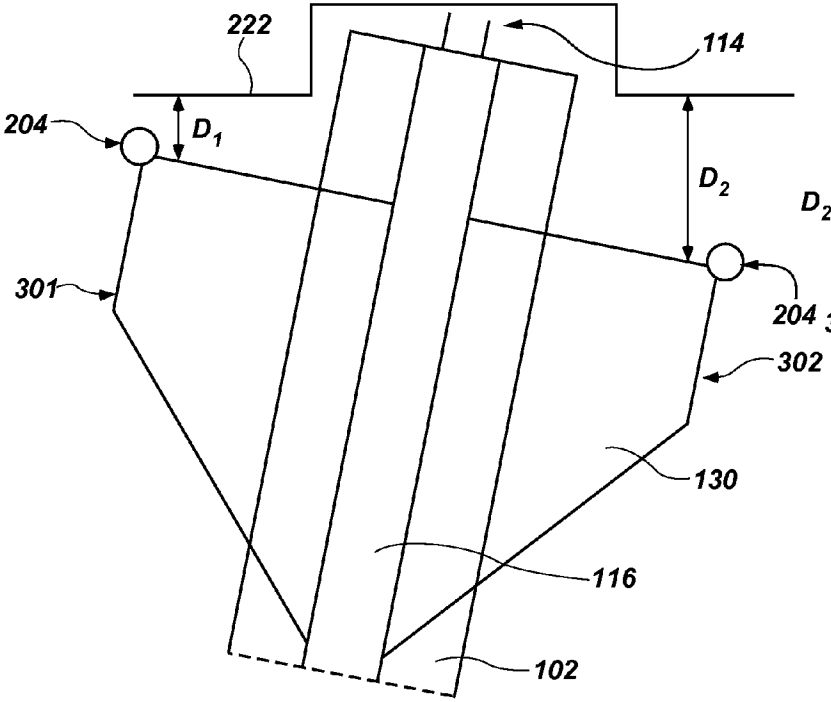

The at least one roller assembly 204 of the vertical alignment structure 130 (FIG. 4) is configured to engage or abut the at least one ramp 131 (FIG. 5) such that if the lead post 116 of the door 102 (FIG. 1) is out of plumb, the at least one ramp 131 will provide a gradually increasing downward pressure on the vertical alignment structure 130 forcing the lead post 116 into the plumb position. FIG. 6 is an enlarged schematic of the vertical alignment structure 130 when the door 102 is out of plumb and before the vertical alignment structure 130 has engaged the at least one ramp 131. FIG. 7 is an enlarged schematic of the vertical alignment structure 130 after the vertical alignment structure 130 has engaged the at least one ramp 131 and the at least one ramp 131 has provided a downward pressure on the vertical alignment structure 130 thus forcing the door 102 into the plumb position. As shown in FIG. 6, when the lead post 116 is out of plumb, a first distance $D_1$ between the at least one roller assembly 204 and the ceiling 222 on a first side 301 of the vertical alignment structure 130 is less than a second distance $D_2$ between the at least one roller assembly 204 and the ceiling 222 on a second side 302 of the vertical alignment structure 130. As shown in FIG. 7, when the at least one roller assembly 204 on the first side 301 of the vertical alignment structure 130 engages or abuts the at least one ramp 131, the at least one ramp 131 provides a downward pressure on the at least one roller assembly 204 causing the first distance $D_1$ to gradually increase to a third distance $D_3$. As the first distance $D_1$ increases, the lead post 116 becomes plumb and the second distance $D_2$ decreases to also equal the third distance $D_3$.

As shown in FIG. 7, at least one ramp 131 may be provided for each roller assembly 204. For example, as illustrated in FIG. 7, the vertical alignment structure 130 includes two roller assemblies 204 and two ramps 131. The two ramps 131 flank each side of track 114 in the ceiling 222. It is noted that, while the exemplary embodiments described hereinabove include a pair of roller assemblies 204 and ramps 131, the invention may be practiced with a single roller assembly 204 and ramp 131. For example, if the door 102 illustrated in FIG. 6 is expected to be consistently out of plumb in one direction, such as if that the first distance $D_1$ is consistently less than the second distance $D_2$, then the at least one roller assembly 204 and the at least one ramp 131 may be placed on only a first side 301 of the vertical alignment structure 130 of the door 102.

The vertical alignment system 129, as illustrated in FIG. 1, of the present invention may offer any number of advantages over the prior art. For example, because the vertical alignment system 129 is coupled to the lead post 116, the floor of a room is unobstructed unlike when a track is placed in the floor of the building to maintain the lead post 116 plumb. Also, previously installed movable partitions or doors 102 may be easily retrofitted with the vertical alignment system 129. Furthermore, because the vertical alignment system 129 does not require any electronics, the vertical alignment system 129 requires minimal upkeep. Other advantages may also be provided by embodiments of the invention.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention includes all modifications, equivalents, and alternatives falling within the spirit and scope of the invention as defined by the following appended claims.

What is claimed is:

1. A method of aligning a leading end of a movable partition, the method comprising:

moving a movable partition along a track toward an extended, closed position;

rolling at least one roller element along at least one ramp proximate the track, the at least one roller element coupled to the movable partition and located laterally beyond a lateral side of the movable partition and outside the track, and the at least one ramp having a ramp surface oriented at an acute angle greater than zero relative to a horizontal plane; and as a result of rolling the at least one roller element along the at least one ramp, vertically orienting a leading end of the movable partition.

2. The method of claim 1, wherein the acute angle greater than zero relative to a horizontal plane is between about five degrees and about thirty degrees from the horizontal plane.

3. The method of claim 1, wherein the at least one roller element is coupled to the movable partition proximate a leading end of the movable partition.

4. The method of claim 1, wherein moving a movable partition along a track comprises moving an accordion-type door along the track.

5. The method of claim 1, wherein rolling at least one roller element along at least one ramp proximate the track comprises rolling the at least one roller element along at least one ramp having a ratio of change in height to change in length of between about one-sixteenth inch per foot and about two inches per foot.

6. The method of claim 1, wherein rolling at least one roller element along at least one ramp proximate the track comprises rolling the at least one roller element along at least one ramp having a length of at least about three feet.

7. The method of claim 1, wherein moving a movable partition along a track toward an extended, closed position comprises moving the movable partition along the track with a drive device.

8. The method of claim 7, wherein moving the movable partition along the track with a drive device comprises moving the movable partition along the track with a motor and at least one of a drive belt and a chain.

9. The method of claim 1, wherein rolling at least one roller element along at least one ramp comprises rolling two roller elements along two respective ramps.

10. The method of claim 9, wherein rolling two roller elements along two respective ramps comprises rolling a first roller element on a first ramp positioned on a first lateral side of the track and rolling a second roller element on a second ramp positioned on a second, opposite lateral side of the track.

11. The method of claim 1, wherein vertically orienting a leading end of the movable partition comprises vertically orienting the leading end of the movable partition to an at least substantially plumb orientation.

12. A movable partition system, comprising:

a movable partition;

a track configured for suspending the movable partition within a building;

at least one ramp configured for installation within the building proximate the track and having a ramp surface configured for orientation at an acute angle greater than zero relative to a horizontal plane; and a vertical alignment structure comprising at least one roller element coupled to the movable partition proximate a leading end of the movable partition, the at least one roller element disposed laterally beyond a lateral side of the movable partition and outside the track and positioned to roll along the ramp surface of the at least one ramp to vertically orient the leading end of the movable partition.

13. The movable partition system of claim 12, wherein the vertical alignment structure comprises at least two roller elements.

14. The movable partition system of claim 13, wherein the at least two roller elements are respectively disposed laterally beyond opposing lateral sides of the movable partition and outside the track.

15. The movable partition system of claim 12, wherein the vertical alignment structure comprises an at least substantially triangular plate, wherein the at least one roller element is coupled to the at least substantially triangular plate proximate a corner of the at least substantially triangular plate.

16. The movable partition system of claim 12, wherein the at least one ramp is sized and configured for abutting against the at least one roller element, the ramp including a base surface and at least one ramp surface extending at an acute angle relative to the base.

17. The movable partition system of claim 12, wherein the at least one vertical alignment structure is coupled to an upper portion of the movable partition.

18. The movable partition system of claim 12, wherein a distance from a center of a leading end of the movable partition and the at least one roller element is between about one-half (½) foot and about three feet.

19. The movable partition system of claim 12, further comprising a drive device configured to move the movable partition along the track upon actuation of the drive device.

20. The movable partition system of claim 19, wherein the drive device comprises a motor coupled to a leading end of the movable partition with a drive belt or chain.

* * * * *